US006869207B2

(12) United States Patent
Lee

(10) Patent No.: US 6,869,207 B2
(45) Date of Patent: Mar. 22, 2005

(54) FOLDABLE LAMP SHADE

(76) Inventor: Ting-Sheng Lee, 58, Ma Yuan West St., Taichung (TW)

( * ) Notice: Subject to any disclaimer, the term of this patent is extended or adjusted under 35 U.S.C. 154(b) by 5 days.

(21) Appl. No.: 10/392,197

(22) Filed: Mar. 17, 2003

(65) Prior Publication Data

US 2004/0184271 A1 Sep. 23, 2004

(51) Int. Cl.[7] ..... F21V 1/06

(52) U.S. Cl. ..... 362/352; 362/357; 362/360; 362/351; 362/395

(58) Field of Search ..... 362/352, 356, 362/357, 360, 351, 395, 367

(56) References Cited

U.S. PATENT DOCUMENTS 6,527,421 B1 * 3/2003 Qing ..... 362/352

* cited by examiner

*Primary Examiner*—Sandra O'Shea
*Assistant Examiner*—Zeade Bertrand
(74) *Attorney, Agent, or Firm*—Alan D. Kamrath; Nikolai & Mersereau, P.A.

(57) ABSTRACT

A foldable lamp shade includes an upper support hoop, a lower support hoop, a cover mounted between the upper support hoop and the lower support hoop, and a plurality of support bars detachably mounted between the upper support hoop and the lower support hoop for supporting and stretching the cover. Thus, the user only needs to insert the locking tenons of each of the support bars into the locking slide slot of the respective locking lug of each of the upper support hoop and the lower support hoop so as to assemble the foldable lamp shade, thereby facilitating assembly and disassembly of the foldable lamp shade.

10 Claims, 7 Drawing Sheets

FOLDABLE LAMP SHADE

BACKGROUND OF THE INVENTION

1. Field of the Invention

The present invention relates to a foldable lamp shade, and more particularly to a foldable lamp shade having various configurations and patterns, thereby greatly enhancing the aesthetic quality of the foldable lamp shade.

2. Description of the Related Art

A conventional lamp shade in accordance with the prior art comprises an upper support hoop, a lower support hoop, a cover mounted between the upper support hoop and the lower support hoop, and a plurality of connecting ribs fixed between the upper support hoop and the lower support hoop for supporting the cover. However, the conventional lamp shade has a fixed structure and cannot be folded, so that it occupies a large space, thereby increasing costs of fabrication, storage and transportation.

SUMMARY OF THE INVENTION

The present invention is to mitigate and/or obviate the disadvantage of the conventional lamp shade.

The primary objective of the present invention is to provide a foldable lamp shade having various configurations and patterns, thereby greatly enhancing the aesthetic quality of the foldable lamp shade.

Another objective of the present invention is to provide a foldable lamp shade that needs not to make elastic members, thereby simplifying the process of fabrication, and thereby decreasing costs of fabrication and transportation.

A further objective of the present invention is to provide a foldable lamp shade, wherein the user only needs to insert the locking tenons of each of the support bars into the locking slide slot of the respective locking lug of each of the upper support hoop and the lower support hoop so as to assemble the foldable lamp shade, thereby facilitating assembly and disassembly of the foldable lamp shade.

A further objective of the present invention is to provide a foldable lamp shade, wherein each of the support bars is secured between the upper support hoop and the lower support hoop rigidly and stably, thereby enhancing the structural strength of the foldable lamp shade.

In accordance with the present invention, there is provided a foldable lamp shade, comprising an upper support hoop, a lower support hoop, a cover mounted between the upper support hoop and the lower support hoop, and a plurality of support bars detachably mounted between the upper support hoop and the lower support hoop for supporting and stretching the cover, wherein:

each of the upper support hoop and the lower support hoop is provided with a plurality of locking lugs each formed with a locking slide slot; and each of the support bars has two ends each formed with a locking tenon that can be inserted into the locking slide slot of the respective locking lug of each of the upper support hoop and the lower support hoop.

Further benefits and advantages of the present invention will become apparent after a careful reading of the detailed description with appropriate reference to the accompanying drawings.

DETAILED DESCRIPTION OF THE INVENTION

Figure 1:
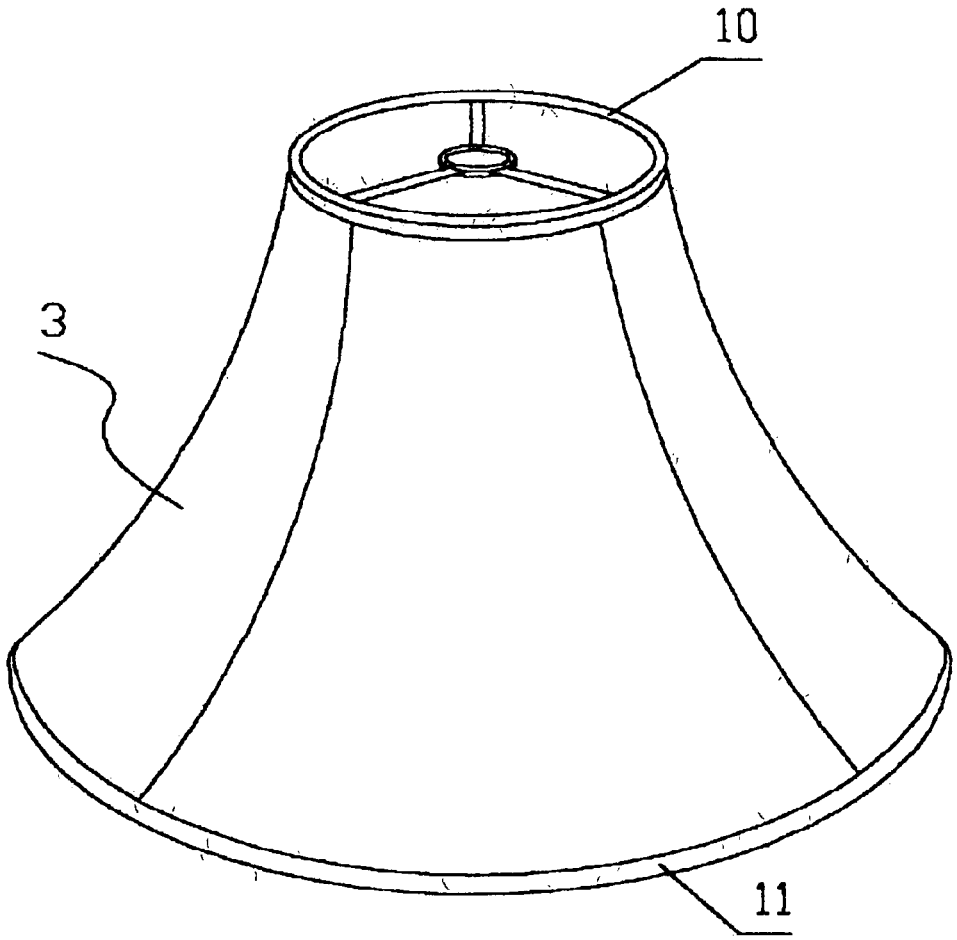
FIG. 1 is a perspective view of a foldable lamp shade in accordance with the preferred embodiment of the present invention.
Figure 2:
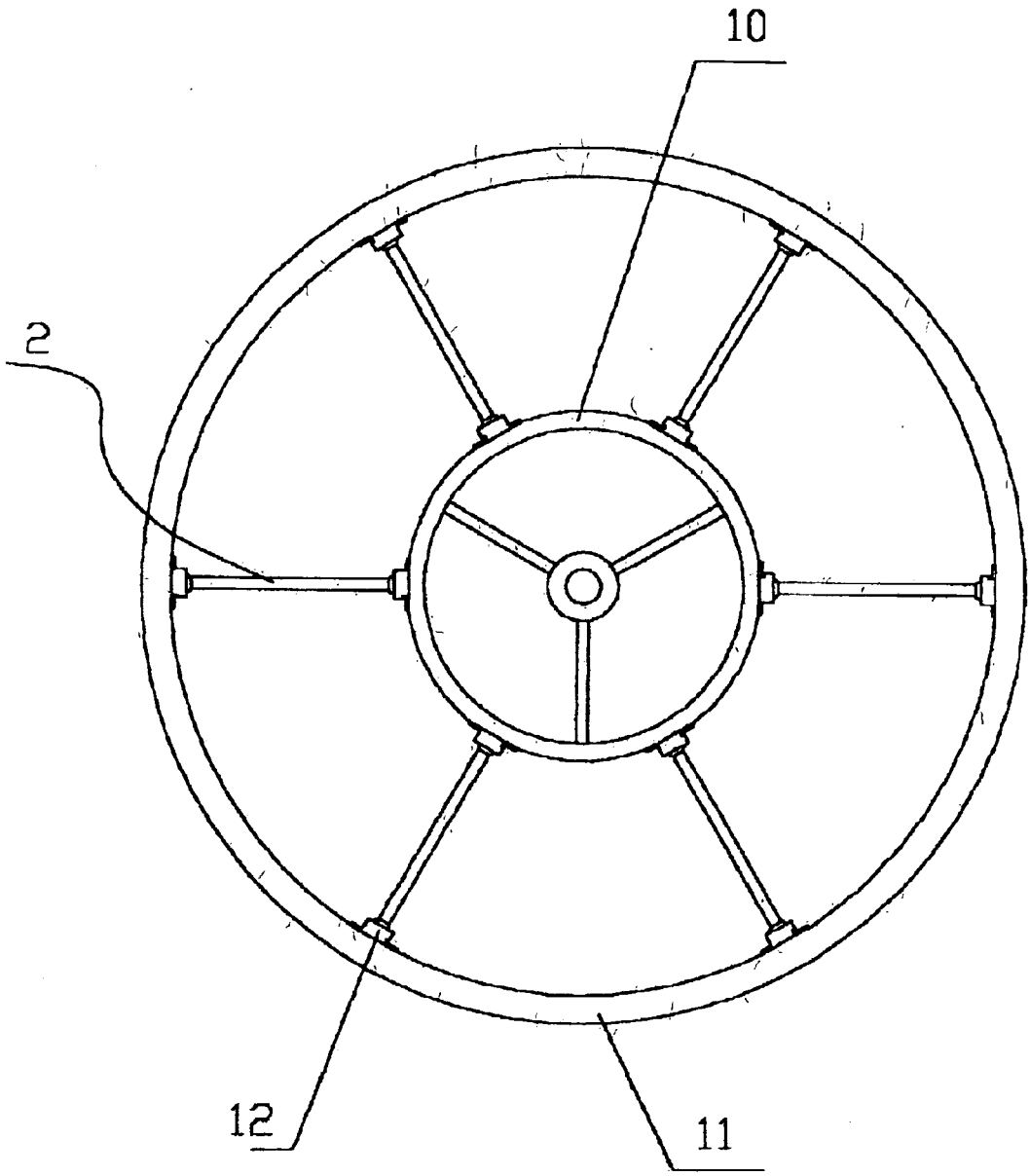
FIG. 2 is a bottom plan view of the foldable lamp shade in accordance with the preferred embodiment of the present invention.

Referring to the drawings and initially to FIGS. 1–6, a foldable lamp shade in accordance with the preferred embodiment of the present invention is available for the table lamp, the floor lamp, the artistic lamp or the like, and comprises an upper support hoop 10, a lower support hoop 11, a cover 3 mounted between the upper support hoop 10 and the lower support hoop 11, and a plurality of support bars 2 detachably mounted between the upper support hoop 10 and the lower support hoop 11 for supporting and stretching the cover 3.

Each of the upper support hoop 10 and the lower support hoop 11 is provided with a plurality of locking lugs 12 each formed with a locking slide slot 120. The locking slide slot 120 has an end face formed with an opening edge 121. Preferably, the opening edges 121 of the upper support hoop 10 and the lower support hoop 11 are directed toward opposite directions.

Each of the support bars 2 has two ends each formed with a locking tenon 20 that can be inserted through the opening edge 121 into the locking slide slot 120 of the respective locking lug 12 of each of the upper support hoop 10 and the lower support hoop 11 easily and conveniently, so that each of the support bars 2 is mounted between the upper support hoop 10 and the lower support hoop 11 rigidly and stably to function as the skeleton of the foldable lamp shade. Preferably, the locking tenon 20 of each of the support bars 2 has a flat shape. The number of the support bars 2 is equal to that of the locking lugs 12 of each of the upper support hoop 10 and the lower support hoop 11. Each of the support bars 2 is flexible with a determined curvature. Each of the support bars 2 has a cylindrical, flat or other shape. Preferably, each of the support bars 2 is mounted inside of the cover 3. Alternatively, each of the support bars 2 is mounted outside of the cover 3.

Figure 7:
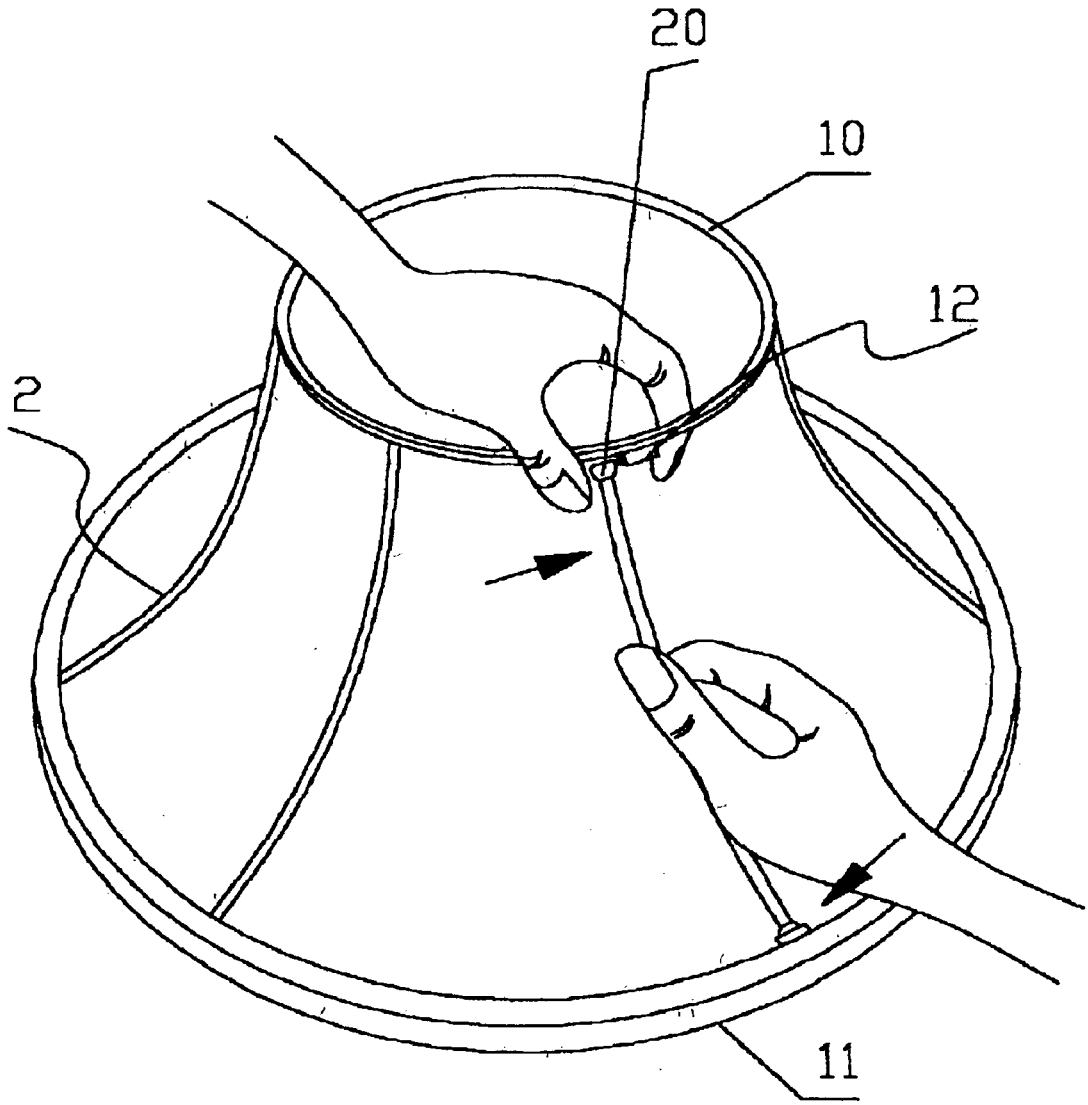
FIG. 7 is a perspective operational view of the foldable lamp shade in accordance with the preferred embodiment of the present invention.

In assembly, referring to FIG. 7, with reference to FIGS. 1–6, the locking tenon 20 of each of the two ends of each of the support bars 2 can be inserted through the opening edge 121 into the locking slide slot 120 of the respective locking lug 12 of each of the upper support hoop 10 and the lower support hoop 11 easily and conveniently, so that each of the support bars 2 is secured between the upper support hoop 10 and the lower support hoop 11 rigidly and stably, thereby forming the foldable lamp shade in accordance with the preferred embodiment of the present invention.

Figure 3:
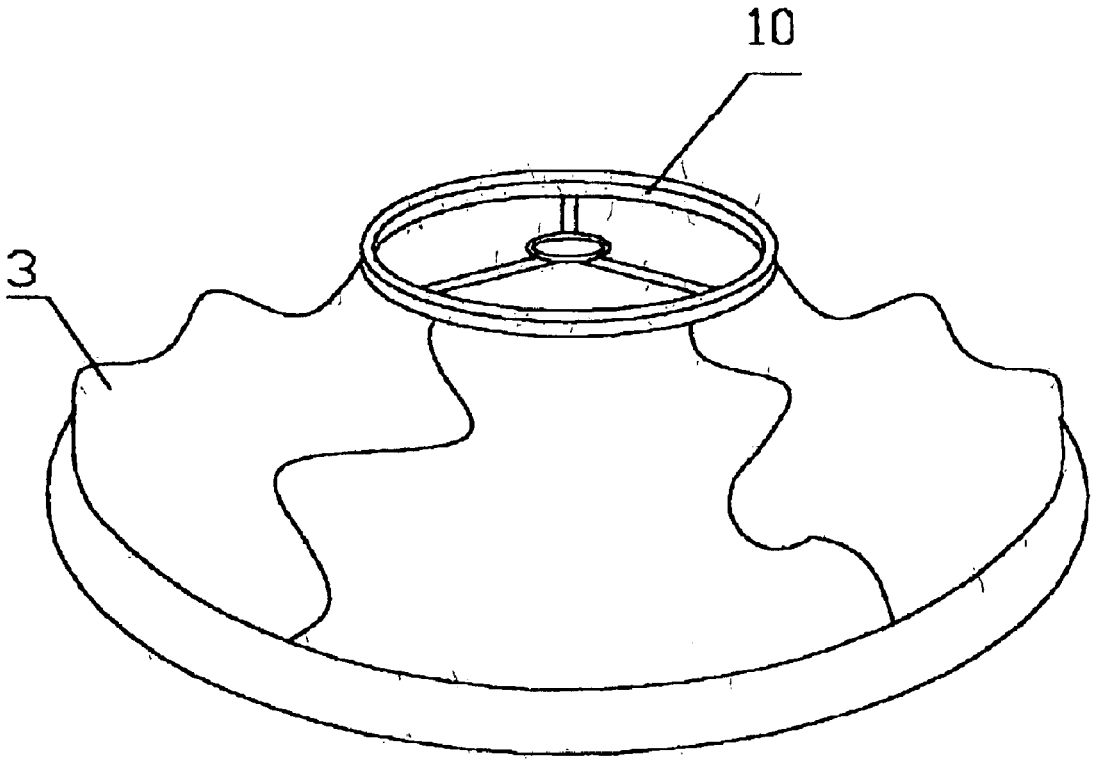
FIG. 3 is a perspective folded view of the foldable lamp shade in accordance with the preferred embodiment of the present invention.
Figure 4:
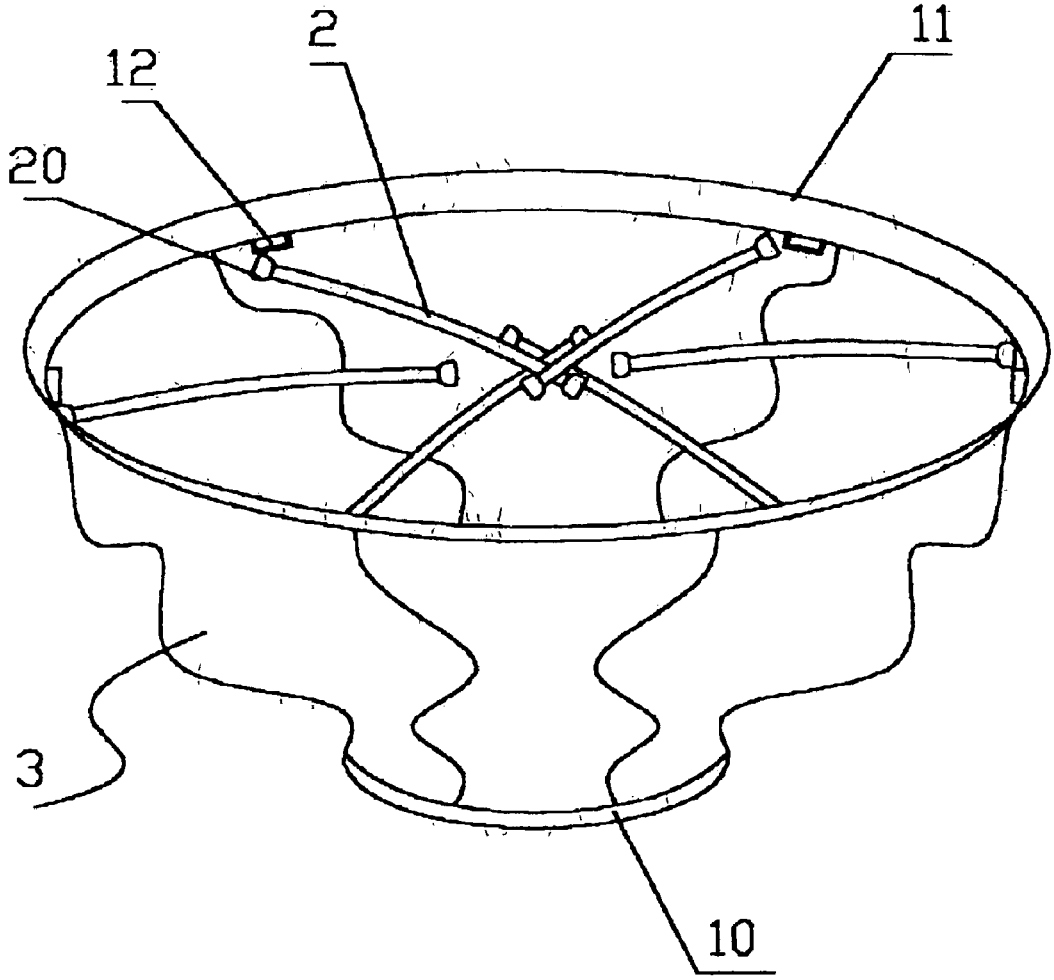
FIG. 4 is a bottom perspective folded view of the foldable lamp shade in accordance with the preferred embodiment of the present invention.
Figure 5:
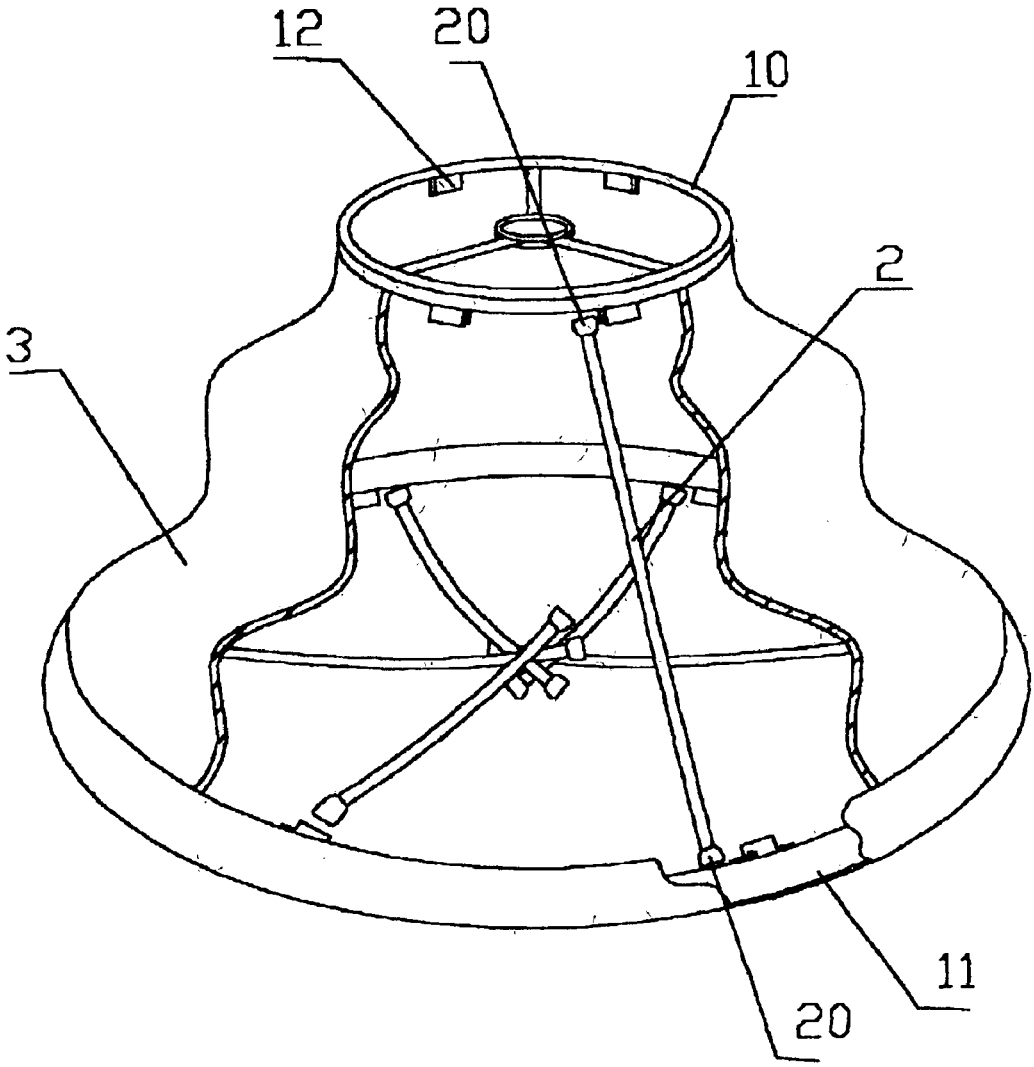
FIG. 5 is a partially cut-away perspective cross-sectional folded view of the foldable lamp shade in accordance with the preferred embodiment of the present invention.
Figure 6:
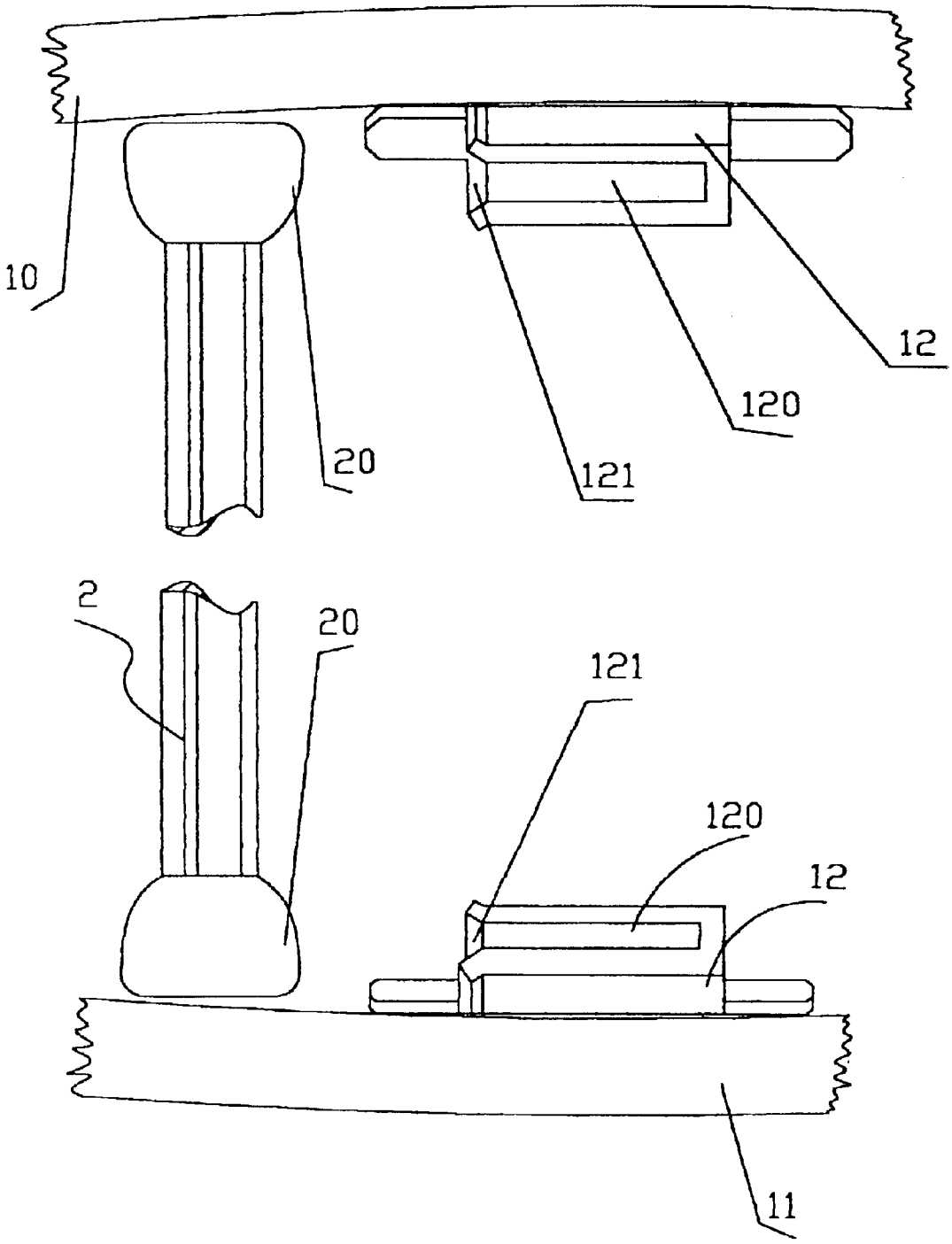
FIG. 6 is a partially cut-away side plan view of the foldable lamp shade as shown in FIG. 5.

In such a manner, the support bars 2 of different shapes and curvatures can be used to support and stretch the cover 3, so that the cover 3 can present different shapes and curvatures as shown in FIGS. 1 and 3, thereby enhancing the aesthetic quality of the foldable lamp shade in accordance with the preferred embodiment of the present invention.

As shown in FIG. 7, the opening edges 121 of the upper support hoop 10 and the lower support hoop 11 are directed toward opposite directions, so that the two locking tenons 20 of each of the support bars 2 can be inserted through the opening edge 121 into the locking slide slot 120 of the respective locking lug 12 of each of the upper support hoop 10 and the lower support hoop 11 along two different directions indicated by arrows, thereby facilitating assembly of the support bars 2, and thereby enhancing the structural strength of the support bars 2.

Accordingly, the foldable lamp shade in accordance with the preferred embodiment of the present invention has the following advantages.

1. The foldable lamp shade needs not to make any elastic snapping member, thereby simplifying the process of fabrication and decreasing costs of fabrication and transportation.

2. The user only needs to insert the locking tenons 20 of each of the support bars 2 into the locking slide slot 120 of the respective locking lug 12 of each of the upper support hoop 10 and the lower support hoop 11 so as to assemble the foldable lamp shade, thereby facilitating assembly and disassembly of the foldable lamp shade.

3. Each of the support bars 2 is secured between the upper support hoop 10 and the lower support hoop 11 rigidly and stably, thereby enhancing the structural strength of the foldable lamp shade.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable lamp shade, comprising an upper support hoop, a lower support hoop, a cover mounted between the upper support hoop and the lower support hoop, and a plurality of support bars detachably mounted between the upper support hoop and the lower support hoop for supporting and stretching the cover, wherein:

each of the upper support hoop and the lower support hoop is provided with a plurality of locking lugs each formed with a locking slide slot; and each of the support bars has two ends each formed with a locking tenon that is movably inserted into and detachably locked in the locking slide slot of the respective locking lug of each of the upper support hoop and the lower support hoop.

2. The foldable lamp shade in accordance with claim 1, wherein the locking slide slot of each of the upper support hoop and the lower support hoop has an end face formed with a tapered opening edge for introducing the locking tenon of each of the support bars into the locking slide slot of the respective locking lug of each of the upper support hoop and the lower support hoop.

3. The foldable lamp shade in accordance with claim 1, wherein the opening edges of the upper support hoop and the lower support hoop are directed toward two opposite directions.

4. The foldable lamp shade in accordance with claim 1, wherein the locking tenon of each of the support bars has a flat shape.

5. The foldable lamp shade in accordance with claim 1, wherein the number of the support bars is equal to that of the locking lugs of each of the upper support hoop and the lower support hoop.

6. The foldable lamp shade in accordance with claim 1, wherein each of the support bars is flexible with a determined curvature.

7. The foldable lamp shade in accordance with claim 1, wherein each of the support bars has a cylindrical shape.

8. The foldable lamp shade in accordance with claim 1, wherein each of the support bars has a flat shape.

9. The foldable lamp shade in accordance with claim 1, wherein each of the support bars is mounted inside of the cover.

10. The foldable lamp shade in accordance with claim 1, wherein each of the support bars is mounted outside of the cover.

* * * * *